US012778269B2

(12) United States Patent
Bai

(10) Patent No.: US 12,778,269 B2
(45) Date of Patent: Nov. 3, 2026

(54) MULTIFUNCTIONAL BACKPACK WITH ADJUSTABLE SHOULDER STRAPS

(71) Applicant: Guangzhou Xiangyu Tongqu Trading Co., Ltd., Guangzhou (CN)

(72) Inventor: Yahui Bai, Qiyang (CN)

(73) Assignee: Guangzhou Xiangyu Tongqu Trading Co., Ltd., Guangzhou (CN)

( * ) Notice: Subject to any disclaimer, the term of this patent is extended or adjusted under 35 U.S.C. 154(b) by 108 days.

(21) Appl. No.: 19/061,022

(22) Filed: Feb. 24, 2025

(65) Prior Publication Data

US 2025/0344834 A1 Nov. 13, 2025

(30) Foreign Application Priority Data

May 8, 2024 (CN) ..... 202420983374.9

(51) Int. Cl.
*A45F 3/04* (2006.01)

(52) U.S. Cl.
CPC ..... *A45F 3/047* (2013.01)

(58) Field of Classification Search
CPC .. A45F 3/04; A45F 3/042; A45F 3/047; A45F 3/02
USPC ..... 224/578–579
See application file for complete search history.

(56) References Cited

U.S. PATENT DOCUMENTS

| | | | | |
|---|---|---|---|---|
| 325,481 | A | 9/1885 | Barron | |
| 3,254,816 | A * | 6/1966 | Gray | A45F 3/04 224/630 |
| 6,105,923 | A * | 8/2000 | Robertson | A45F 5/02 24/3.12 |
| 10,010,146 | B2 * | 7/2018 | Moore | A45C 13/26 |
| 10,736,391 | B2 * | 8/2020 | Seiders | A45C 9/00 |
| 2018/0252458 | A1 * | 9/2018 | Furneaux | A45C 11/20 |
| 2020/0245745 | A1 * | 8/2020 | Smith | A45F 3/047 |
| 2021/0100340 | A1 * | 4/2021 | Chang | A45F 3/047 |

FOREIGN PATENT DOCUMENTS

CN 111358159 A 7/2020

* cited by examiner

*Primary Examiner* — Adam J Waggenspack
(74) *Attorney, Agent, or Firm* — JEEN IP LAW, LLC

(57) ABSTRACT

A multifunctional backpack with adjustable shoulder strap is provided, which includes a backpack body and a shoulder strap. A lower of the shoulder strap is connected to the backpack body, and there are two or more sheet bodies extending along a transverse direction of the backpack body on an upper of the backpack body. Two sides of the sheet bodies are connected to the backpack body, and an insertion hole is formed between middles of the sheet bodies and the backpack body. A hook buckle is connected to an upper of the shoulder strap; the hook buckle includes a hook buckle main body and a hook buckle connector. One end of the shoulder strap is connected to the hook buckle main body, and a bottom of the hook buckle main body and a bottom of the hook buckle connector are connected by a bottom plate.

10 Claims, 6 Drawing Sheets

MULTIFUNCTIONAL BACKPACK WITH ADJUSTABLE SHOULDER STRAPS

CROSS-REFERENCE TO RELATED APPLICATIONS

This application claims priority to Chinese Patent Application No. 202420983374.9, filed on May 8, 2024, which is hereby incorporated by reference in its entirety.

TECHNICAL FIELD

The present disclosure relates to the field of backpack technologies, and in particular, to a multifunctional backpack with adjustable shoulder strap.

BACKGROUND

Backpack refers to a general term for a bag that is carried on the back when going out. With the continuous improvement of people's living and consumption standards, backpacks have become an indispensable item around them, and people have increasingly high requirements for the practicality and comfort of the backpacks. The specifications of backpacks produced by manufacturers are generally fixed, but users' skeletons are different. Therefore, conventional backpacks with fixed straps are not suitable for all users. Besides that, when a regular backpack is carried on a person's back, the force points are concentrated on the shoulders, and other parts of the back are almost not subjected to force, so the shoulder is prone to fatigue. Over time, this will affect the user's physical health, especially for primary and secondary school students in their developmental stage.

CN202010141549.8 discloses a directly molded high ventilation backpack, which slides the shoulder strap into a bar shaped sliding groove. However, this way cannot fix the shoulder strap, and it is prone to continuous displacement during use, rendering it difficult for the user to adapt.

For example, US1964369117 discloses a reinforced backpack with shoulder straps. The backpack is connected to the shoulder straps by setting a plurality of pairs of holes, and the holes and locks are directly connected point-to-point. This reduces the contact area between the shoulder straps and the backpack body, increases the pressure between the shoulder straps and the backpack body, and easily causes deformation of the connection between the shoulder straps and the backpack body, which may ultimately damage the shoulder straps. Furthermore, with this structure, when connecting or removing the shoulder straps to or from the holes, the locks need to be opened to achieve this. Therefore, the installation and removal of the shoulder straps are inconvenient and inefficient.

SUMMARY

The present disclosure provides a multifunctional backpack with adjustable shoulder strap, which is provided with a plurality of sheet bodies for accommodating hook buckles, and an insertion hole is formed between the sheet bodies and the backpack body, so that the shoulder straps can be adjusted according to a user's shoulder width. The operation is simple, the use is convenient, and the service life is long.

To achieve the above objectives, the technical solution of the present disclosure is: a multifunctional backpack with adjustable shoulder strap, including a backpack body and a shoulder strap, a lower of the shoulder strap is connected to the backpack body, there are two or more sheet bodies extending along a transverse direction of the backpack body on an upper of the backpack body, two sides of the sheet bodies are connected to the backpack body, an insertion hole is formed between middle of the sheet bodies and the backpack body, a hook buckle is connected to an upper of the shoulder strap, and the hook buckle includes a hook buckle main body and a hook buckle connector; one end of the shoulder strap is connected to the hook buckle main body, a bottom of the hook buckle main body and a bottom of the hook buckle connector are connected by a bottom plate; a clamp slot is formed between the hook buckle main body and the hook buckle connector, and the hook buckle connector is inserted into a lower of the insertion hole so that the sheet bodies are located in the clamp slot to achieve a connection between the shoulder strap and the backpack body; the bottom plate is located below the sheet bodies.

In the above structure, the shoulder strap can be adjusted according to the user's shoulder width by providing with a plurality of sheet bodies and forming the insertion hole between the sheet bodies and the backpack body. The operation is simple and easy to use. The hook buckle connector is inserted into the insertion hole so that the sheet bodies are located in the clamp slot so as to adjust the shoulder strap. During use, gravity center of the backpack body causes the sheet bodies to move downward. By restricting the sheet bodies through the bottom plate, the sheet bodies can be restricted in the clamp slot. The structure is simple, and the sheet bodies are restricted in the clamp slot as a whole. Therefore, a contact area between the sheet bodies and the hook buckle is large, so the sheet bodies are not easily deformed or damaged, and the service life is long. Besides that, the hook buckle connector can be limited by two sides of the insertion hole. Therefore, when the hook buckle connector is inserted into the insertion hole, the hook buckle is not easily swayed in the insertion hole. Thus, it is more reliable to use.

In some embodiments of the present disclosure, two or more sheet bodies are considered as a single piece, and stitching lines are provided between adjacent sheet bodies to connect to the backpack body.

By the above settings, the sheet bodies are connected through the stitching lines, with a simple and reliable structure.

In some embodiments of the present disclosure, the overall sheet bodies are a woven strap.

By the above settings, the woven strap forms the sheet bodies, with a simple and reliable structure.

In some embodiments of the present disclosure, there is a connection hole at the upper of the hook body, and the upper of the shoulder strap is connected to the connection hole.

The above settings facilitate the connection of the shoulder strap through the connection hole.

In some embodiments of the present disclosure, the backpack body includes a front backpack body and a rear backpack body, the front backpack body and the rear backpack body are connected by a connection strap, and the sheet bodies are provided on the rear backpack body.

In some embodiments of the present disclosure, the front backpack body includes a front backpack main body and front side plates provided on two sides of the front backpack main body, the rear backpack body includes a rear backpack main body and rear side plates provided on two sides of the rear backpack main body, the front side plates and the rear side plates located on the same side are connected by a zipper.

In the above settings, the backpack body includes the front backpack body and rear backpack body, and the front backpack body and the rear backpack body are connected by the zipper. Thus, the backpack body can be unfolded when the zipper is opened, rendering it easier to clean the inside of the backpack body.

In some embodiments of the present disclosure, a bag cover is connected to an upper of the rear backpack body.

The upper of the backpack body can be covered with the back cover, allowing items inside the backpack to leak out from the upper.

In some embodiments of the present disclosure, one end of the bag cover is connected to the upper of the rear backpack body, and the other end of the bag cover is connected to the front backpack body through a buckle.

In the above settings, the bag cover is fixed to the front backpack body through the buckle, thereby preventing items inside the backpacks body from leaking out from the upper.

In some embodiments of the present disclosure, an accessory bag and one or more pen caps are provided on an inner side of the bag cover; and a hanging strap is provided at a top of the bag cover.

In the above settings, the accessory bag and the pen caps are added on the bag cover, rendering it easier for the user to take more items.

In some embodiments of the present disclosure, a storage bag is provided at a bottom of the backpack body.

By the above settings, the storage bag is convenient for the user to store valuable items.

DESCRIPTION OF EMBODIMENTS

Below, a further detailed explanation of the present disclosure will be provided in combination with the accompanying drawings and specific implementation modes.

Figure 1:
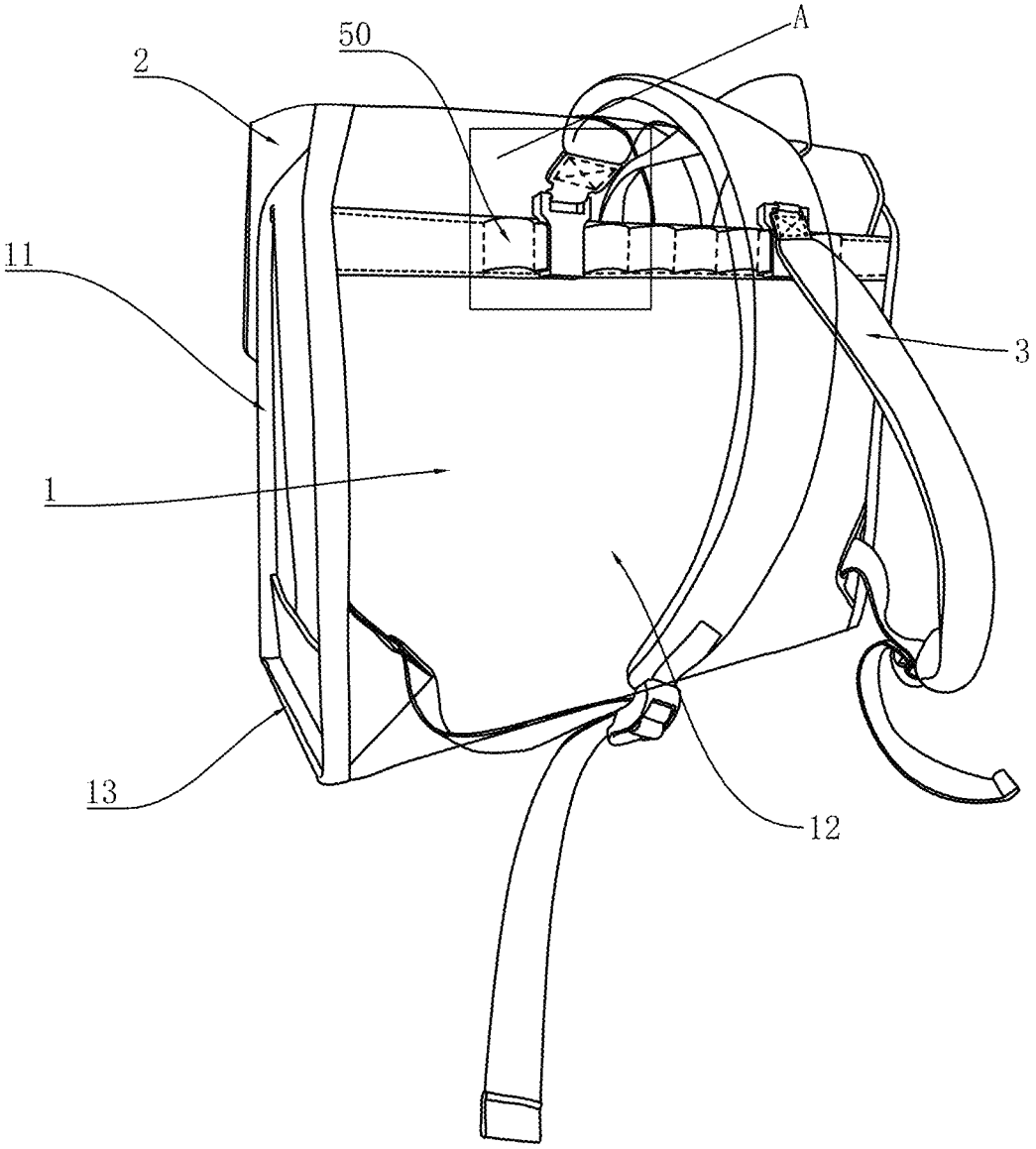
FIG. 1 is a three-dimensional schematic diagram of the present disclosure.
Figure 2:
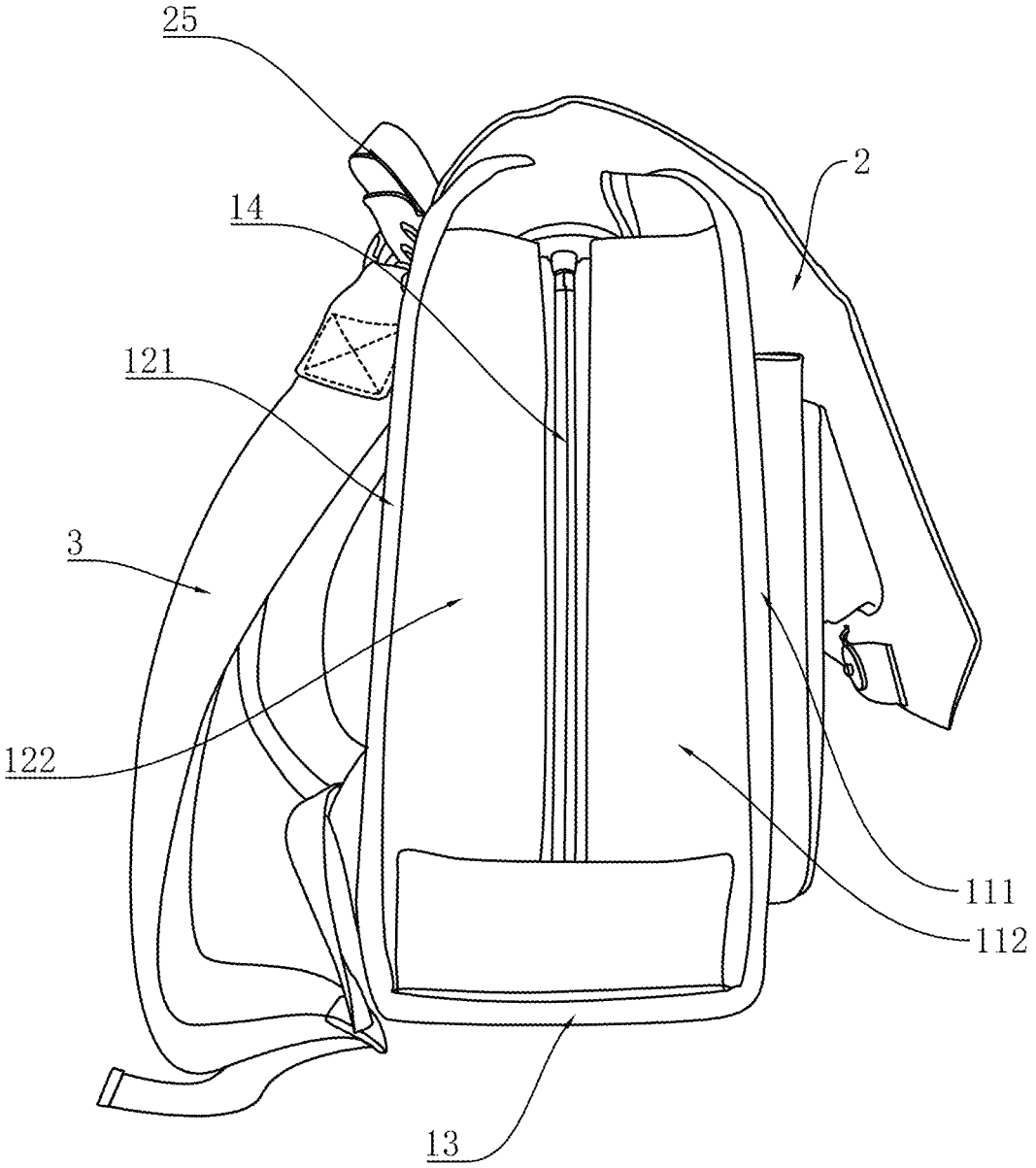
FIG. 2 is a side view of the present disclosure.
Figure 3:
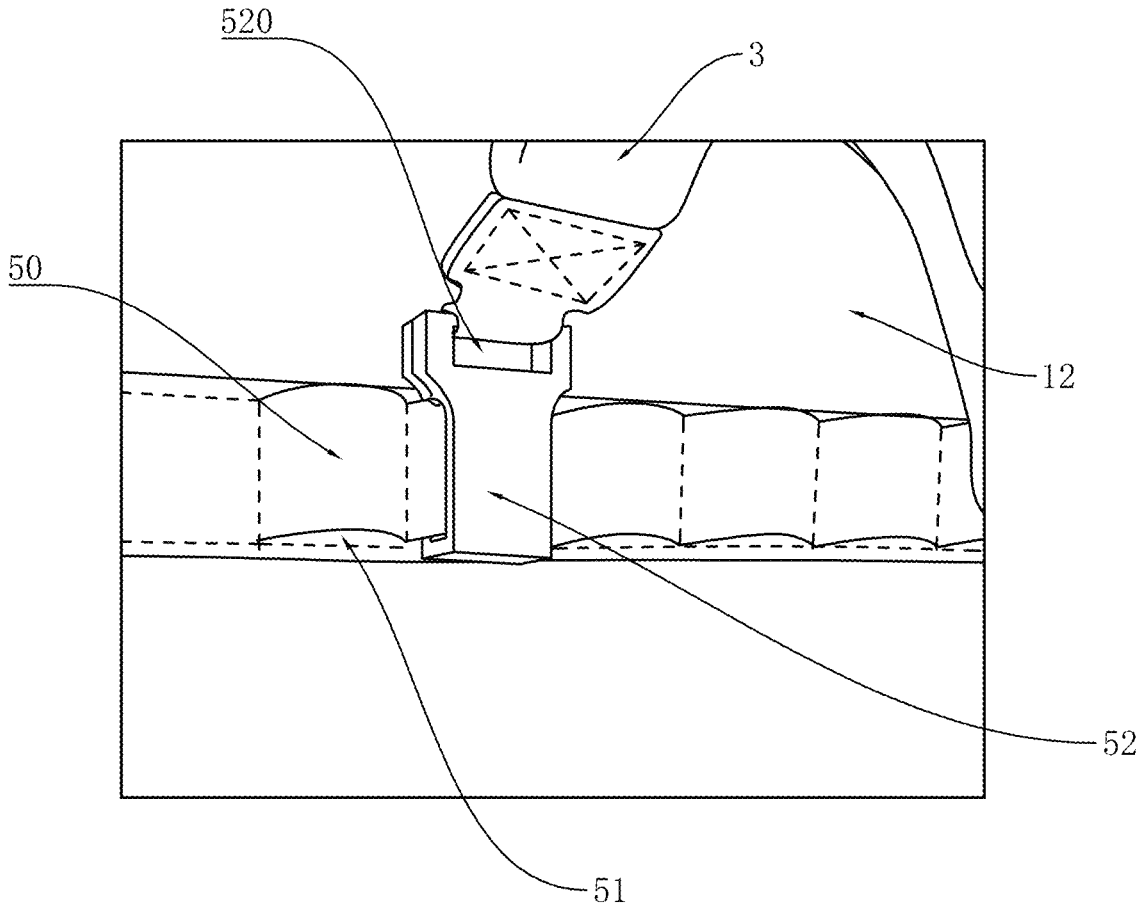
FIG. 3 is an enlarged view of point A in FIG. 1.
Figure 4:
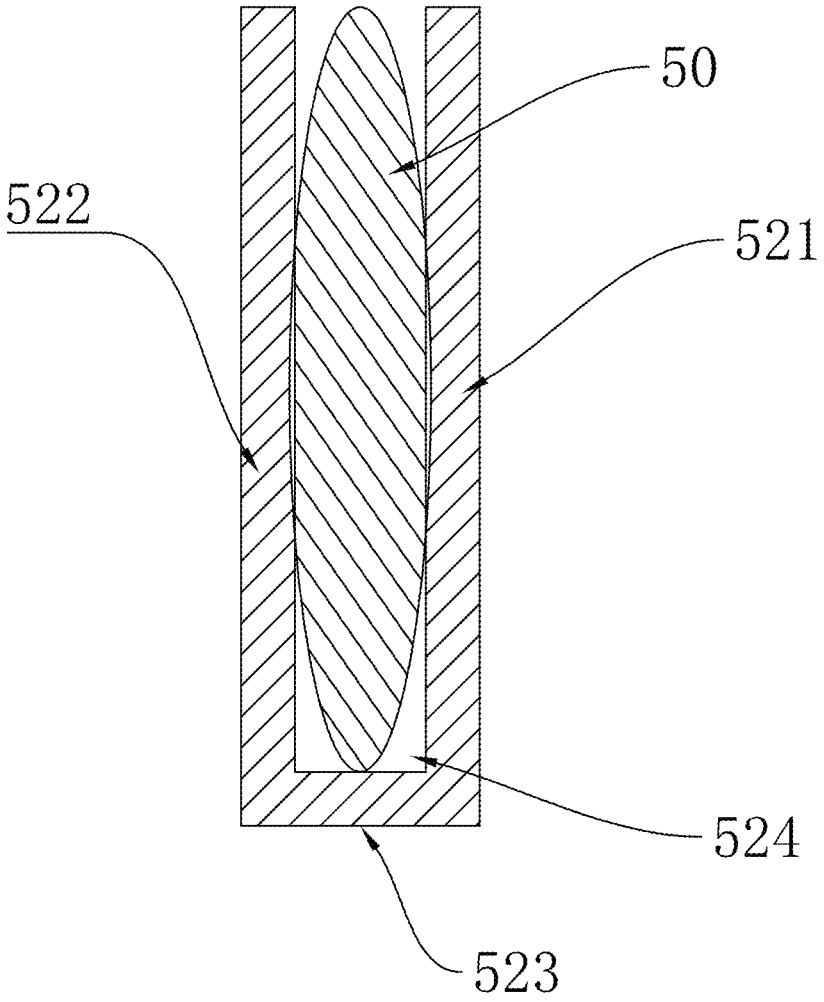
FIG. 4 is a schematic diagram of a connection between sheet bodies and a hook buckle of the present disclosure.

As shown in FIGS. 1 to 6, a multifunctional backpack with adjustable shoulder strap includes a backpack body 1, a bag cover 2, and a shoulder strap 3. The backpack body 1 includes a front backpack body 11 and a rear backpack body 12, the front backpack body 11 and the rear backpack body 12 are connected by a connection strap 13. The bag cover 2 is connected to an upper of the rear backpack body 12, and the shoulder strap 3 is connected to the rear backpack body 12. There are two or more sheet bodies 50 extending along a transverse direction of the rear backpack body 12 on the rear backpack body 12. Two sides of the sheet bodies 50 are connected to the rear backpack body 12 by stitching lines, and an insertion hole 51 is formed between middles of the sheet bodies 50 and the rear backpack body 12. The two or more sheet bodies 50 are integral sheet bodies, and the stitching lines are provided between adjacent sheet bodies 50 to connect to the package body 1. In this embodiment, the integral sheet bodies are a woven strap. A lower of the shoulder strap 3 is connected to the rear backpack body, and a hook buckle 52 is connected to an upper of the shoulder strap 3. The hook buckle 52 includes a hook buckle main body 521 and a hook buckle connector 522. One end of the shoulder strap 3 is connected to the hook buckle main body 521, and a bottom of the hook buckle main body 521 and a bottom of the hook buckle connector 522 are connected by a bottom plate 523. A clamp slot 524 is formed between the hook buckle main body 521 and the hook buckle connector 522, and the hook buckle connector 522 is inserted into the insertion hole 51 from a lower of the insertion hole, so that the sheet bodies 50 are located in the clamp slot 524 to achieve a connection between the shoulder strap 3 and the backpack body 1 (as shown in FIGS. 3 and 4). The bottom plate 523 is located below the sheet bodies 50. There is a connection hole 520 at an upper of the hook buckle main body, and the upper of the shoulder strap is connected to the connection hole 520, which facilitates the connection of the shoulder strap.

The front package body 11 includes a front backpack main body 111 and front side plates 112 provided on two sides of the front backpack main body 111. The rear backpack body 12 includes a rear backpack main body 121 and rear side plates 122 provided on two sides of the rear backpack main body 121. The front side plates 112 and the rear side plates 122 located on the same side are connected by a zipper 14.

By setting the front backpack body 11 and the rear backpack body 12 on the backpack body 1, and connecting them with the zipper 14 between the front backpack body 11 and the rear backpack body 12, the backpack body can be unfolded when the zipper 14 is opened, rendering it easier to clean the inside of the backpack body.

Figure 5:
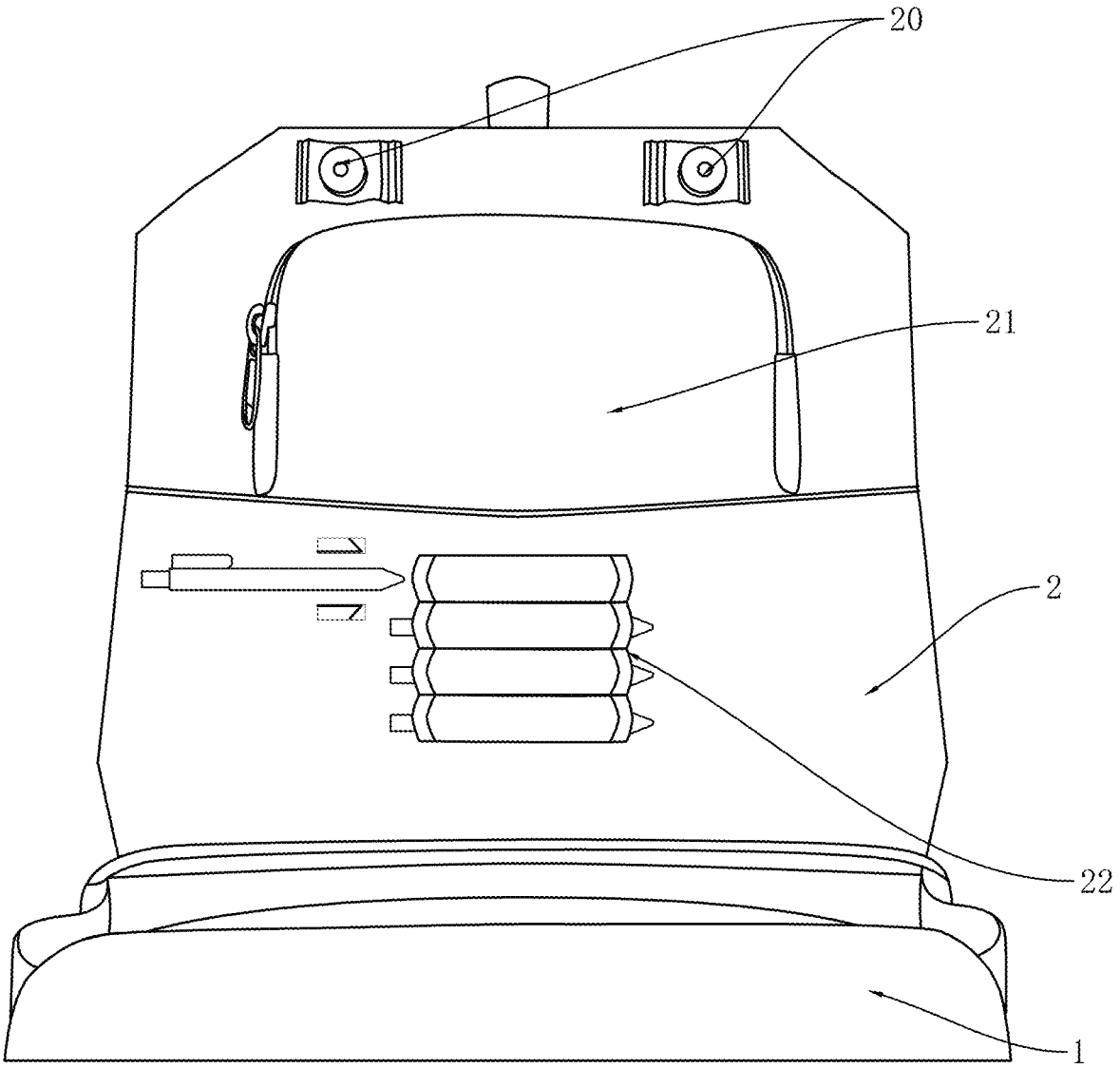
FIG. 5 is a schematic diagram of an inner side of a bag cover of the present disclosure.

As shown in FIG. 5, one end of the bag cover 2 is connected to the upper of the rear backpack body 12, and the other end of the bag cover 2 is connected to the front backpack body 11 through a buckle 20.

It is convenient to fix the bag cover 2 to the front backpack body 11 through the buckle, thereby preventing the items inside the backpack body from leaking out from the upper.

As shown in FIG. 5, there is an accessory bag 21 and one or more pen caps 22 on an inner side of the bag cover 2.

The accessory bag 21 and the pen caps 22 are added to the bag cover 2, rendering it easier for the user to take more items.

Figure 6:
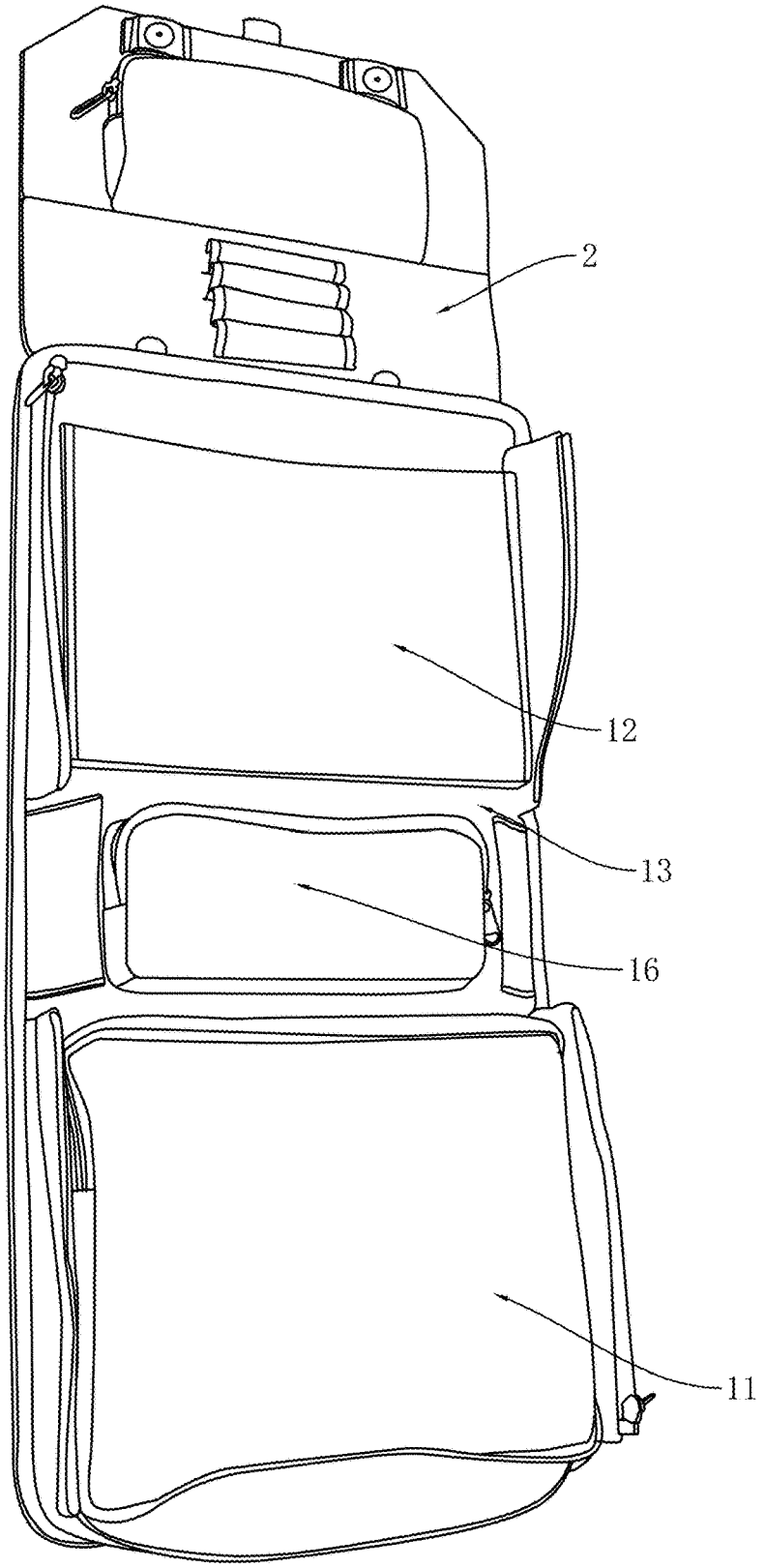
FIG. 6 is a schematic diagram of an unfolded package body of the present disclosure.

As shown in FIG. 6, a storage bag 16 is provided at a bottom of the backpack body 1.

It is convenient for the user to store valuable items through the storage bag 16.

As shown in FIG. 2, there is also a hanging strap 25 provided at a top of the bag cover 2.

By the hanging strap 25, it is convenient for the user to hang the backpacks on a side of a desk or other table for daily use.

The working principle of the present disclosure is to set a plurality of sheet bodies and form the insertion hole between the sheet bodies and the backpack body, so that the shoulder strap can be adjusted according to the user's shoulder width. The operation is simple and easy to use. The hook buckle connector is inserted into the insertion hole so that the sheet bodies are located in the clamp slot, thus realizing the adjustment of the shoulder strap. During use, the gravity center of the backpack body causes the sheet bodies to move downward. By restricting the sheet bodies through the bottom plate, the sheet bodies can be restricted in the clamp slot. The structure is simple, and the sheet bodies are restricted in the clamp slot as a whole. Therefore, the contact area between the sheet bodies and the hook buckle is large, so the sheet bodies are not easily deformed or damaged, and the service life is long. Besides that, the two sides of the insertion hole can be used to restrict the hook buckle connector for limiting the position. When the hook buckle connector is inserted into the insertion hole, the hook buckle is not easily swing in the insertion hole. Thus, it is more reliable to use.

What is claimed is:

1. A multifunctional backpack with adjustable shoulder strap, comprising a backpack body and a shoulder strap, a lower of the shoulder strap is connected to the backpack body, there are two or more sheet bodies extending along a transverse direction of the backpack body on an upper of the backpack body, two sides of the sheet bodies are connected to the backpack body, an insertion hole is formed between middle of the sheet bodies and the backpack body, a hook buckle is connected to an upper of the shoulder strap, and the hook buckle comprises a hook buckle main body and a hook buckle connector;

one end of the shoulder strap is connected to the hook buckle main body, a bottom of the hook buckle main body and a bottom of the hook buckle connector are connected by a bottom plate;

a clamp slot is formed between the hook buckle main body and the hook buckle connector, and the hook buckle connector is inserted into a lower of the insertion hole so that the sheet bodies are located in the clamp slot to achieve a connection between the shoulder strap and the backpack body;

the bottom plate is located below the sheet bodies.

2. The multifunctional backpack with adjustable shoulder strap according to claim 1, wherein the sheet bodies are integral sheet bodies, and stitching lines are provided between adjacent sheet bodies to connect to the backpack body.

3. The multifunctional backpack with adjustable shoulder strap according to claim 2, wherein the overall sheet bodies are a woven strap.

4. The multifunctional backpack with adjustable shoulder strap according to claim 1, wherein a connection hole is provided at an upper of the hook buckle main body, and the upper of the shoulder strap is connected to the connection hole.

5. The multifunctional backpack with adjustable shoulder strap according to claim 1, wherein the backpack body comprises a front backpack body and a rear backpack body, the front backpack body and the rear backpack body are connected by a connection strap, and the sheet bodies are provided on the rear backpack body.

6. The multifunctional backpack with adjustable shoulder strap according to claim 5, wherein the front backpack body comprises a front backpack main body and front side plates provided on two sides of the front backpack main body, the rear backpack body comprises a rear backpack main body and rear side plates provided on two sides of the rear backpack main body, the front side plates and the rear side plates located on the same side are connected by a zipper.

7. The multifunctional backpack with adjustable shoulder strap according to claim 6, wherein a bag cover is connected to an upper of the rear backpack body.

8. The multifunctional backpack with adjustable shoulder strap according to claim 7, wherein one end of the bag cover is connected to the upper of the rear backpack body, and the other end of the bag cover is connected to the front backpack body through a buckle.

9. The multifunctional backpack with adjustable shoulder strap according to claim 7, wherein an accessory bag and one or more pen caps are provided on an inner side of the bag cover; and a hanging strap is provided at a top of the bag cover.

10. The multifunctional backpack with adjustable shoulder strap according to claim 1, wherein a storage bag is provided at a bottom of the backpack body.

* * * * *